US006065854A

United States Patent [19]

West et al.

[11] Patent Number: 6,065,854

[45] Date of Patent: May 23, 2000

[54] LED MODULAR DISPLAY SYSTEM

[75] Inventors: Derik West; Erik Jensen, both of Logan, Utah

[73] Assignee: Integrated Systems Engineering Inc., Logan, Utah

[21] Appl. No.: 09/226,471

[22] Filed: Jan. 7, 1999

[51] Int. Cl.[7] ..... F21V 21/00

[52] U.S. Cl. ..... 362/249; 362/252; 362/239; 362/133; 362/800; 248/127; 211/87.01; 211/94.01

[58] Field of Search ..... 362/249, 252, 362/234, 133, 800; 248/127; 211/87.01, 94.01

[56] References Cited

U.S. PATENT DOCUMENTS 3,405,809 10/1968 Schatz ..... 211/87.01

5,765,940 6/1998 Lery et al. ..... 362/240

*Primary Examiner*—Sandra O'Shea
*Assistant Examiner*—Bertrand Zeade
*Attorney, Agent, or Firm*—Pitney, Hardin, Kipp & Szuch, LLP

[57] ABSTRACT

The LED modular display system includes a frame of support members of triangular cross sections. The frame supports a plurality of LED display modules which include a generally planar front face upon which an array of LEDs is placed. The LED display modules further include inwardly tapered vertical sidewalls and horizontal upper and lower trapezoidal faces. The support members of triangular cross section fit flush against the inwardly tapered vertical sidewalls of the LED display modules. Fasteners on the inwardly tapering walls of the LED display modules engage complementary elements on the support members.

6 Claims, 2 Drawing Sheets

LED MODULAR DISPLAY SYSTEM

BACKGROUND OF THE INVENTION

1. Field of the Invention

This invention pertains to an LED modular display system wherein the modules have a generally planar front display face including an array of LEDs and inwardly tapering vertical sidewalls thereby forming trapezoidally shaped upper and lower horizontal walls. The inwardly tapering sidewalls fit flush with structural support members which have a triangular cross section and are secured thereto.

2. Description of the Prior Art

The use of LED modules to construct display systems is known in the prior art. However, the prior art displays have typically used "I-beams" or similar structural members for vertical support, and the orthogonally shaped LED modules have been bolted to the vertical structural members. However, the I-beams are heavy in order to resist wind loading in outdoor applications, and further do not allow for the easy removal of individual modules from either side (front or rear) of the vertical element.

Additionally, these prior art designs sometimes have difficulty in maintaining a distance between LEDs of adjacent modules equal to the spacing between LEDs within the same module. Any deficiency in maintaining this distance results in grid lines or mullions. Similar difficulties have arisen in maintaining alignment between LEDs of adjacent modules.

OBJECTS AND SUMMARY OF THE INVENTION

It is therefore an object of the present invention to provide an LED modular display system which uses vertical members which are reduced in weight from an I-beam.

It is therefore a further object of the present invention to provide an LED modular display system provides for simplified removal of the LED modules from the display system.

It is therefore a still further object of the present invention to provide an LED modular display system which allows the modules to be removed from either the front or the rear of the display system.

It is therefore a still further object of the present invention to provide an LED modular display system which provides for accurate spacing of LEDs between adjacent modules.

These and other objects are attained by an LED modular display system with vertical supports of triangular cross section. The LED modules have a rectangular front display face with an array of LEDs thereon. The LED modules further have inwardly tapering vertical sidewalls thereby forming a trapezoidal shape of the upper and lower horizontal walls. The inwardly tapering sidewalls engage against and are fastened to the triangular cross section of the vertical support elements. The LED display modules, when rotated ninety degrees about a vertical axis can be inserted or replaced from the rear of the display system.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
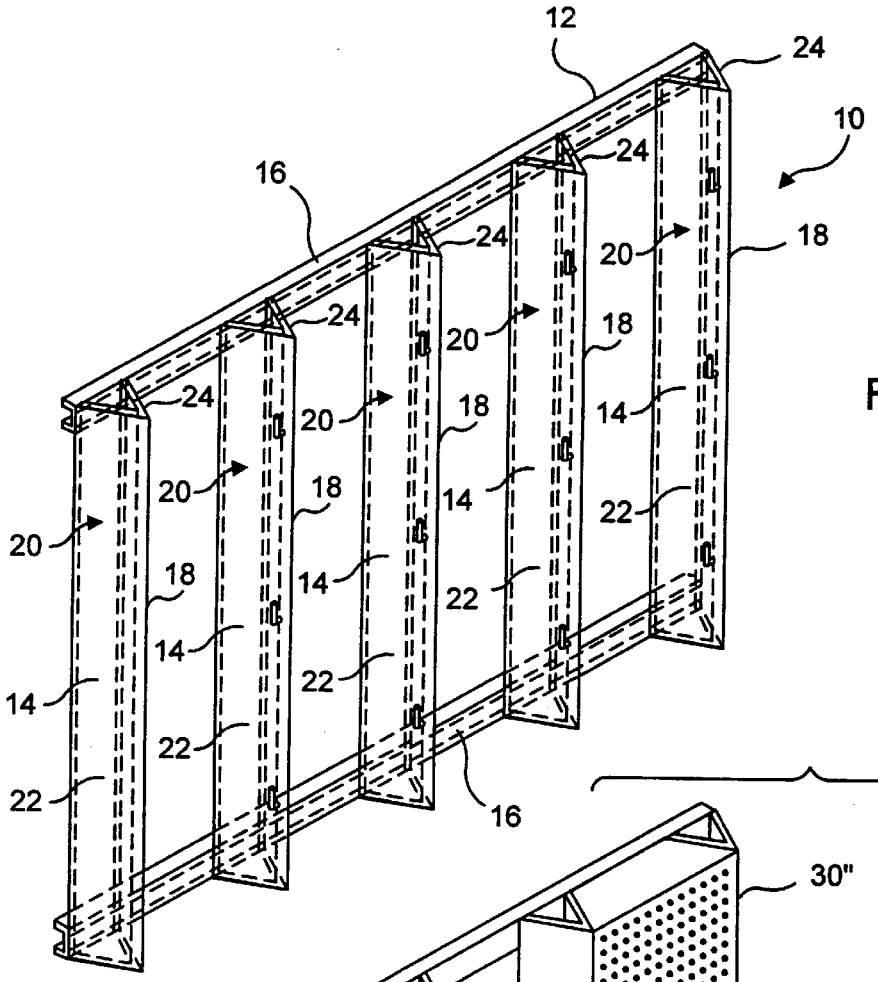
FIG. 1 is a front perspective view of the triangular member frame of the LED modular display system of the present invention.

Referring now to the drawings in detail wherein like numerals refer to like elements throughout the several views, one sees that FIG. 1 is a perspective view of the frame 12 of LED modular display system 10. Frame 12 is comprised of parallel vertical support sections 14 of triangular cross section and secured by horizontal beams 16. The triangular cross section of vertical support section 14 includes a tip 18 pointed toward the front of LED modular display system 10 and a planar section 20 at the rear of LED modular display system 10 which abuts horizontal beams 16. The vertical support sections 14 further include tapered walls 22, 24 which extend from tip 18 to planar section 20. Therefore, planar section 20 and tapered walls 22, 24 form the three walls of the triangular cross section. Tapered walls 22, 24 of vertical support sections further include regularly spaced slots 26 which engage the module fasteners of LED modules 30 as described hereinafter.

Figure 4:
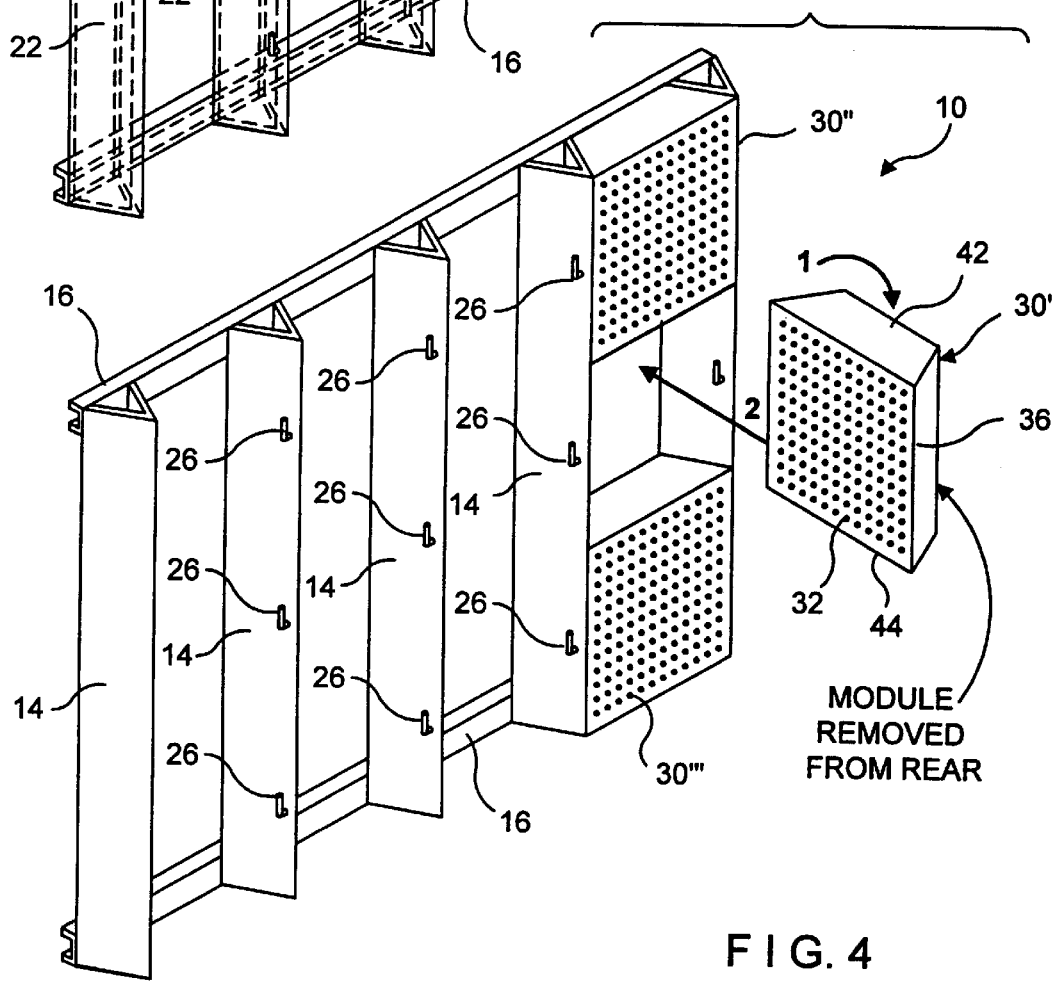
FIG. 4 is a front perspective view of the triangular member frame of the LED modular display system of the present invention, including two installed LED modules and another LED module which has been rotated for access through the rear of the LED modular display system.
Figure 2:
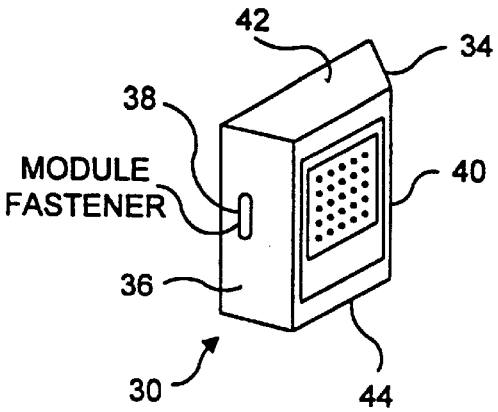
FIG. 2 is a rear perspective view of an LED module of the LED modular display system of the present invention.
Figure 3:
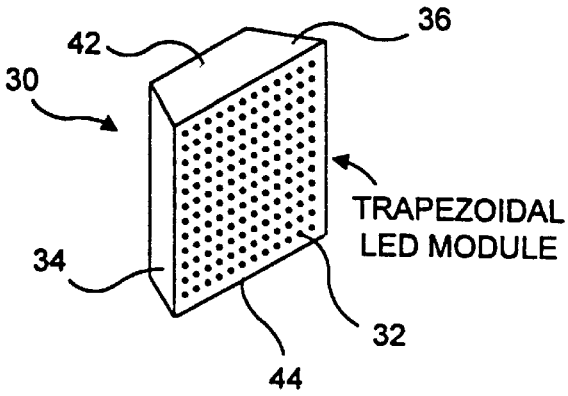
FIG. 3 is a front perspective view of an LED module of the LED modular display system of the present invention.
Figure 5:
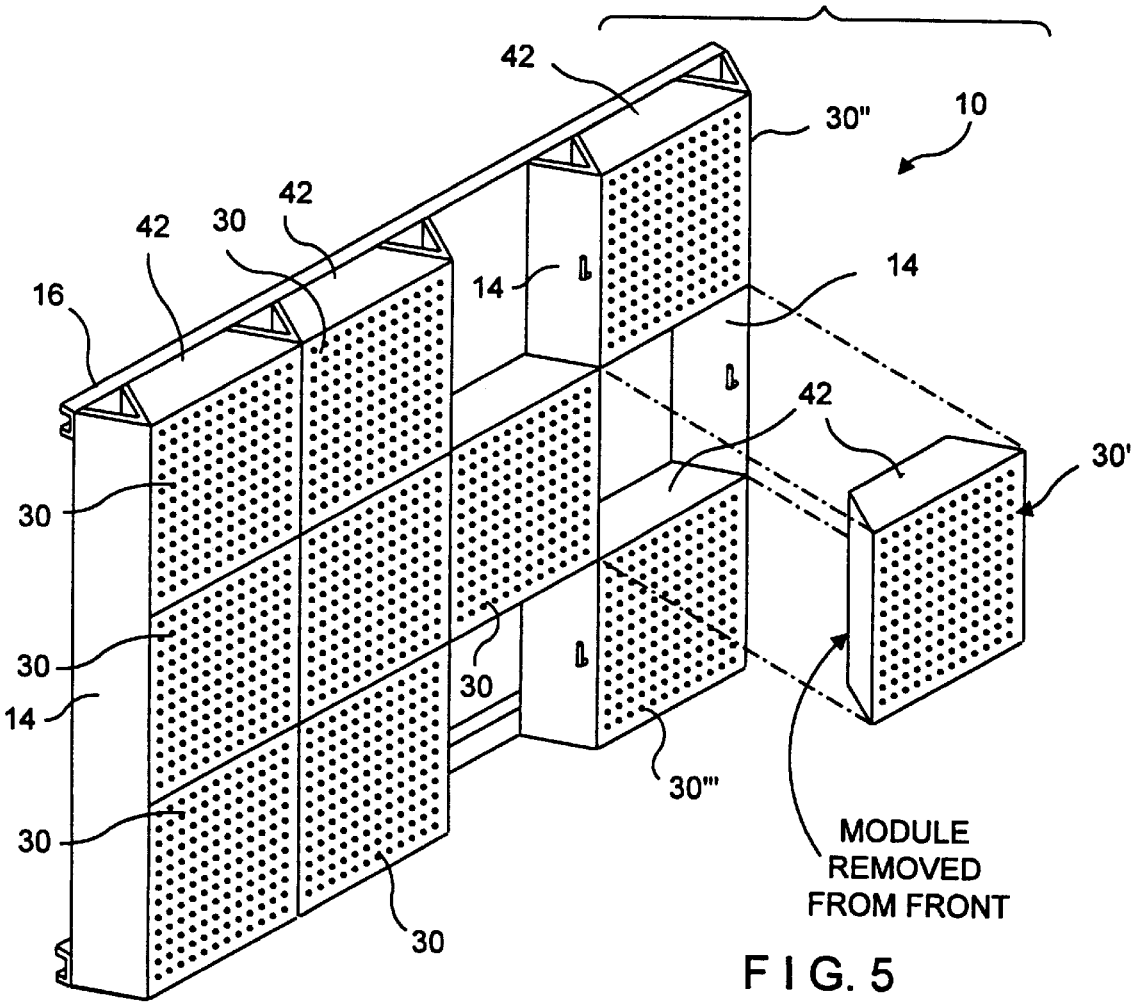
FIG. 5 is a front perspective view, partially exploded, of the LED modular display system of the present invention, with several installed LED modules and one LED module shown in an exploded position.

FIGS. 2 and 3 illustrate the LED modules 30 which are used in the LED modular display system 10. LED modules 30 include a generally planar front rectangular face 32 ("rectangular" being used in its broad sense to provide for the possibility of a square) which includes an array of LEDs for display purposes. LED modules 30 further include inwardly tapering vertical rectangular sidewalls 34, 36. The angle of taper of vertical rectangular sidewalls 34, 36 is chosen to provide for a flush fit of inwardly tapering vertical rectangular sidewalls 34, 36 against the tapered walls 22, 24 of vertical support sections 14 as illustrated in FIGS. 4 and 5. As shown in FIG. 2, inwardly tapering vertical rectangular sidewalls 34, 36 of LED modules 30 further include module fasteners 38 which engage the regularly spaced slots 26 of tapered walls 22, 24 of vertical support sections 14. While module fasteners 38 are contemplated as being internal fasteners which are rotated 180° from either side of the LED modular display system 10 to engage and disengage, one skilled in the art will recognize that there are many different fasteners may be used for this purpose.

LED module 30 further includes rear rectangular wall 40 with a socket configuration through which the various control and power connections are made to the LEDs of front rectangular face 32. This is typically done with a plug (not shown) with a plurality of prearranged electrical connections to engage the socket configuration of rear rectangular wall 40.

LED module 30 further includes upper and lower horizontal trapezoidal walls 42, 44, respectively, the trapezoidal shape being formed by the edges of inwardly tapering vertical rectangular sidewalls 34, 36 and the edges of front and rear faces 32, 40, respectively. As shown in FIG. 4, the horizontal character of upper and lower horizontal trapezoidal walls 42, 44 allows the user to rotate an unengaged LED module 30' about a vertical axis by ninety degrees and thereafter pass LED module 30' between upwardly adjacent and downwardly adjacent LED modules 30" and 30'", respectively. This allows module 30' to be removed from the rear as shown in FIG. 4 or from the front as shown in FIG. 5.

As shown in FIG. 5, LED modules 30 (and 30', 30", 30'") are arranged in an array to form the display surface of LED modular display system 10. The configuration of the LED modules 30, particularly the trapezoidal shape of the upper and lower walls 42, 44 as formed by the inwardly tapering vertical rectangular sidewalls 34, 36, allows for a very tight fit between adjacent LED modules 30 thereby essentially eliminating grid lines and mullions between adjacent LED modules 30.

In order to install LED modular display system 10, the frame 12 is installed and the various LED modules 30 are attached to the frame 12 by the engagement of module fasteners 38 to slots 26. The plugs (not shown) are then attached to the sockets on the rear face 40 of the LED modules 30 to provide the power and control signals.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. An LED modular display system comprising:

a frame including a plurality of support members oriented in a first direction, said support members having tapered vertical sides thereby forming a substantially triangular cross section, said support members further including first attachment elements;

a plurality of LED display modules, said LED display modules including a generally planar front face with an array of LEDs thereon, vertical sidewalls tapering inwardly from said front face, said vertical sidewalls further including second attachment elements;

wherein said tapered vertical sides of said support elements fit flush against said inwardly tapering vertical sidewalls of said LED display modules; and wherein said first attachment elements engage said second attachment elements thereby attaching said LED display modules to said frame.

2. The LED modular display system of claim 1 wherein said plurality of LED display modules include horizontal upper walls and horizontal lower walls.

3. The LED modular display system of claim 2 wherein said plurality of LED display modules include a rear face through which electrical connections are made to said array of LEDs.

4. The LED modular display system of claim 3 wherein said horizontal upper walls and said horizontal lower walls of said plurality of LED display modules are trapezoidal.

5. The LED modular display system of claim 4 wherein a trapezoidal shape of said horizontal upper walls and said horizontal lower walls includes parallel edges formed by said front face and said rear face and two non-parallel edges formed by said inwardly tapering vertical sidewalls.

6. The LED modular display system of claim 5 wherein said first direction is vertical.

* * * * *